US010569843B2

(12) United States Patent
Kiellerup

(10) Patent No.: US 10,569,843 B2
(45) Date of Patent: Feb. 25, 2020

(54) TRANSPORTABLE FOLDING BOAT STRUCTURE

(71) Applicant: Aaron Kiellerup, Nambour (AU)

(72) Inventor: Aaron Kiellerup, Nambour (AU)

( * ) Notice: Subject to any disclaimer, the term of this patent is extended or adjusted under 35 U.S.C. 154(b) by 0 days.

(21) Appl. No.: 16/073,147

(22) PCT Filed: Jan. 27, 2017

(86) PCT No.: PCT/AU2017/050061
§ 371 (c)(1),
(2) Date: Jul. 26, 2018

(87) PCT Pub. No.: WO2017/127891
PCT Pub. Date: Aug. 3, 2017

(65) Prior Publication Data

US 2019/0039695 A1 Feb. 7, 2019

(30) Foreign Application Priority Data

Jan. 27, 2016 (AU) ..... 2016900232

(51) Int. Cl.
*B63B 35/36* (2006.01)
*B63B 1/10* (2006.01)

(52) U.S. Cl.
CPC ..... *B63B 35/36* (2013.01); *B63B 1/10* (2013.01)

(58) Field of Classification Search
CPC .. B63B 7/00; B63B 7/04; B63B 21/00; B63B 21/64; B63B 1/00; B63B 1/10; B63B 35/00; B63B 35/36
USPC ..... 114/61.18, 344, 353, 354
See application file for complete search history.

(56) References Cited

U.S. PATENT DOCUMENTS

| | | | | |
|---|---|---|---|---|
| 3,763,511 | A | 10/1973 | Sisil | |
| 4,040,134 | A | 8/1977 | Downing | |
| 4,768,454 | A * | 9/1988 | Selken | B63B 7/02 114/344 |
| 5,617,810 | A | 4/1997 | Sauerwein | |
| 7,021,228 | B2 * | 4/2006 | Robb | B63B 7/04 114/344 |

FOREIGN PATENT DOCUMENTS

| | | | |
|---|---|---|---|
| AU | 2009202083 | B1 | 10/2009 |
| WO | 2007066055 | A2 | 6/2007 |

OTHER PUBLICATIONS

International Search Report & Written Opinion dated May 16, 2017 from PCT Application No. PCT/AU2017/050061.

* cited by examiner

*Primary Examiner* — Lars A Olson
(74) *Attorney, Agent, or Firm* — Innovation Capital Law Group, LLP; Vic Lin

(57) ABSTRACT

There is provided a folding boat structure for facilitating transportation, the structure comprising: a central structure having a fixed primary hull; outrigging supporting at least one secondary hull structure having a secondary hull to the central structure, wherein: the outrigging is double hinged so as to be user configurable in a deployed configuration and a stowed configuration and wherein: in the deployed configuration, the at least one secondary hull is located laterally adjacent the main hull and downwardly orientated; and in the stowed configuration, the at least one secondary hull is located above the main hull and upwardly orientated.

19 Claims, 9 Drawing Sheets

TRANSPORTABLE FOLDING BOAT STRUCTURE

FIELD OF THE INVENTION

The present invention relates to boat designs and in particular, but not necessarily entirely, to a transportable folding boat structure.

BACKGROUND OF THE INVENTION

Boat designs compromise between deck area and transportability. For example, boat designs having large comfortable deck area are usually permanently left in water whereas those boats that are suited for transportability conversely have very small deck areas.

Generally, transportable boats must be narrower than 2.5 m to meet roadworthy requirements.

Existing folding boats are generally very intricate and/or cumbersome to set up, some of which require fastening together of framework portions, insertion of floats and the like.

The present invention seeks to provide a boat structure for facilitating transportation, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

In accordance with present embodiments, there is provided a folding boat structure that is relatively easy to deploy.

Specifically, present embodiments utilise double hinged outrigging supporting a pair of secondary hull structures.

In this way, such outrigging is able to be deployed to provide a wide and stable deck. For stowage, the outrigging folds at the double hinges such that the secondary hull structures locate above the primary hull structure so as to provide a compact structure suitable for road trailer transportation.

Furthermore, such an arrangement is suited for mechanised actuation wherein an electric motor may be utilised to draw stay cables acting upwardly on the outrigging.

Further, embodiments comprises additional features including utilising a gate a locking mechanism to hold the deployed outrigging, having elevating deck structures and the like.

As such, with the foregoing in mind, according to one aspect, there is provided a folding boat structure for facilitating transportation, the structure comprising: a central structure having a fixed primary hull; outrigging supporting at least one secondary hull structure having a secondary hull to the central structure, wherein: the outrigging may be double hinged so as to be user configurable in a deployed configuration and a stowed configuration and wherein: in the deployed configuration, the at least one secondary hull may be located laterally adjacent the main hull and downwardly orientated; and in the stowed configuration, the at least one secondary hull may be located above the main hull and upwardly orientated.

The outrigging may comprise a beam hingedly coupled at each end of the beam to the central structure and the secondary hull structure respectively.

The boat structure further may comprise at least one railing fixed to the secondary hull structure, and wherein, in the stowed configuration, the railing may be configured for bearing against the beam so as to limit the travel of the secondary hull structure with respect to the beam at an approximate right angle.

The structure further may comprise a beam holding mechanism to hold the beam in the deployed configuration.

The beam holding mechanism may comprise a hinged gate configured to swing outwards in the deployed configuration.

In the deployed configuration, the hinged gate may latch to the railing.

The folding boat structure may further comprise a winch system to transition the structure between the deployed and stowed configurations.

The winch system may comprise a mast and winch cables and wherein the winch cables travel upwards through the mast and subsequently exit the mast to as to reach laterally for fastening to the secondary float structure.

The secondary float structure may comprise recessed winch cable fastener engagements.

The folding boat structure may further comprise a bimini.

The bimini may be height adjustable, and wherein, in the deployed configuration, the bimini may be raised and wherein, in the stowed configuration, the bimini may be lowered.

In the stowed configuration, the bimini may rest against the secondary hulls.

The bimini may comprise a telescopic member.

The folding boat structure may further comprise a compartmentalising framework compartmentalising the deck into a plurality of rooms and wherein, in the stowed configuration, the secondary hull structure may be configured for resting upon the compartmentalising framework.

The structure further may comprise elevating walling fastened between the compartmentalising framework and the bimini such that, when the bimini may be raised in the deployed configuration, the elevating walling extends upwardly from the compartmentalising framework.

In the stowed configuration, the structure may have a width of approximately 2.5 m or less In the deployed configuration, the structure may have a width of approximately 5.8 m or more.

The structure may have a length of approximately 9 m.

Other aspects of the invention are also disclosed.

BRIEF DESCRIPTION OF THE DRAWINGS

Notwithstanding any other forms which may fall within the scope of the present invention, a preferred embodiment of the disclosure will now be described, by way of example only, with reference to the accompanying drawings in which:

FIG. 6-9 show exemplary perspective views of the boat structure transitioning from the stowed configuration to the deployed configuration wherein FIG. 6 shows the boat structure in the stowed configuration wherein the secondary hulls are above the primary hulls; FIG. 7 shows the outrigging pivoting about the inner hinges while being lowered by winch cables, FIG. 8 shows the outrigging pivoting about the outer hinges in FIG. 9 shows the outrigging secured in the deployed configurations utilising gates.

DESCRIPTION OF EMBODIMENTS

Figure 1:
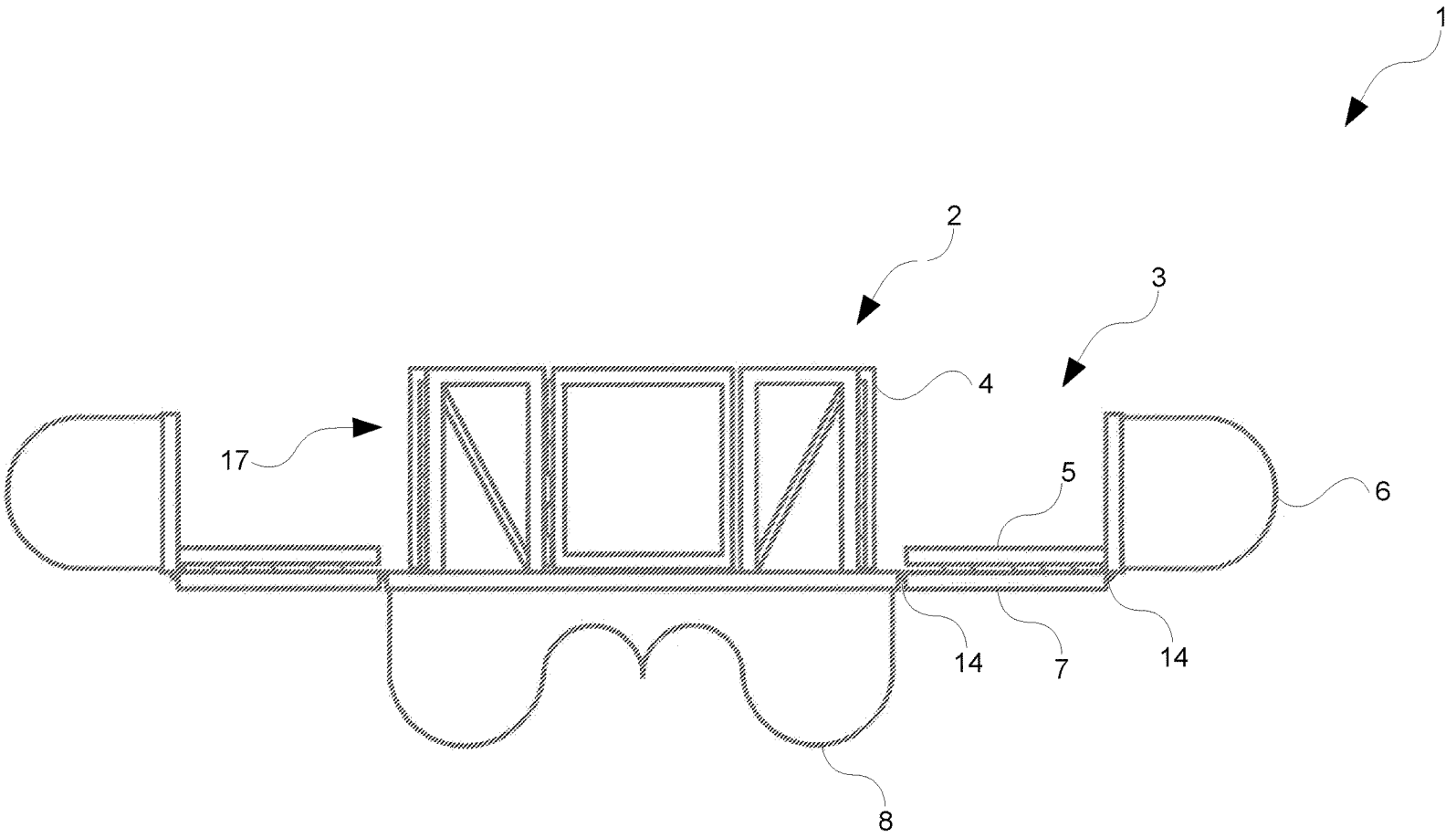
FIG. 1 shows a front elevation view of a folding boat structure for facilitating transportation transitioning between a deployed configuration and a stowed configuration in accordance with a preferred embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

Before the structures, systems and associated methods relating to the folding boat structure are disclosed and described, it is to be understood that this disclosure is not limited to the particular configurations, process steps, and materials disclosed herein as such may vary somewhat. It is also to be understood that the terminology employed herein is used for the purpose of describing particular embodiments only and is not intended to be limiting since the scope of the disclosure will be limited only by the claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterised by," and grammatical equivalents thereof are inclusive or open-ended terms that do not exclude additional, unrecited elements or method steps.

It should be noted in the following description that like or the same reference numerals in different embodiments denote the same or similar features.

Turning now to FIG. 1, there is shown a folding boat structure 1 for facilitating transportation.

As will be described in the subsequent embodiments, the boat structure 1 is configurable in a deployed configuration for use on water (or even as land based accommodation in lieu of, for example, caravans), and in a stowed configuration so as to be able to be loaded onto a trailer or the like for transportation.

Specifically, in the embodiment shown in the accompanying figures, in embodiments, in the deployed configuration the structure 1 has a width of approximately 6 m whereas, in the stowed configuration, the structure 1 has a width of substantially 2.5 m.

Furthermore, in the deployed configuration in accordance with this embodiment, the structure 1 has a length of approximately 9 m thereby having a deck area of approximately 54 $m^2$.

As can be appreciated, the bi-hinged folding mechanism described herein provides a boat structure having a larger usable deck area when deployed while yet being able to fold so as to have a width of less than 2.5 m so as to be lawfully transported by road.

Figure 3:
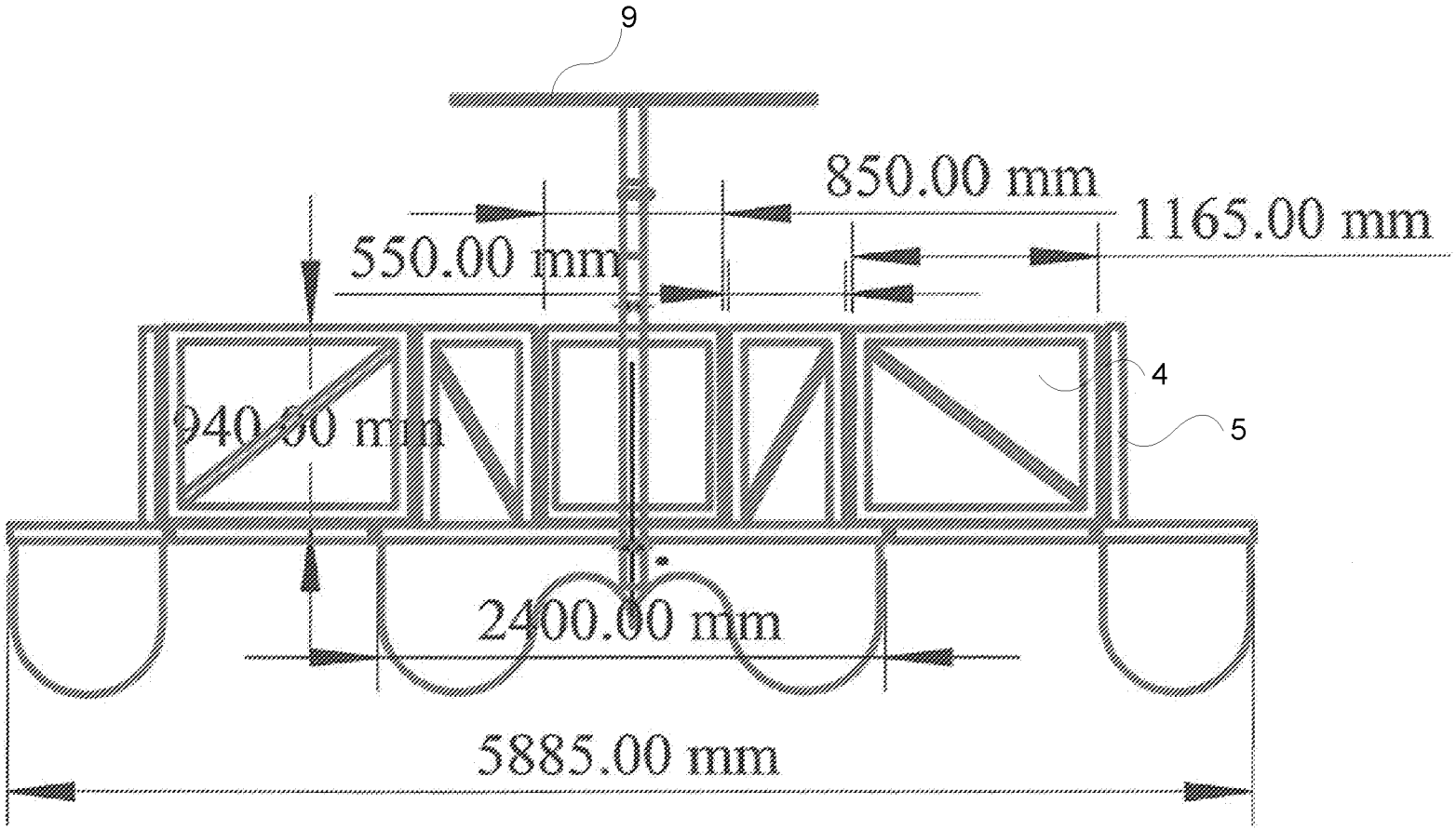
FIG. 3 shows a front elevation view of the boat structure in the deployed configuration, including exemplary dimensions, comprising hinged gates closed to rigidly hold the outrigging in the deployed configuration in accordance with an embodiment.
Figure 4:
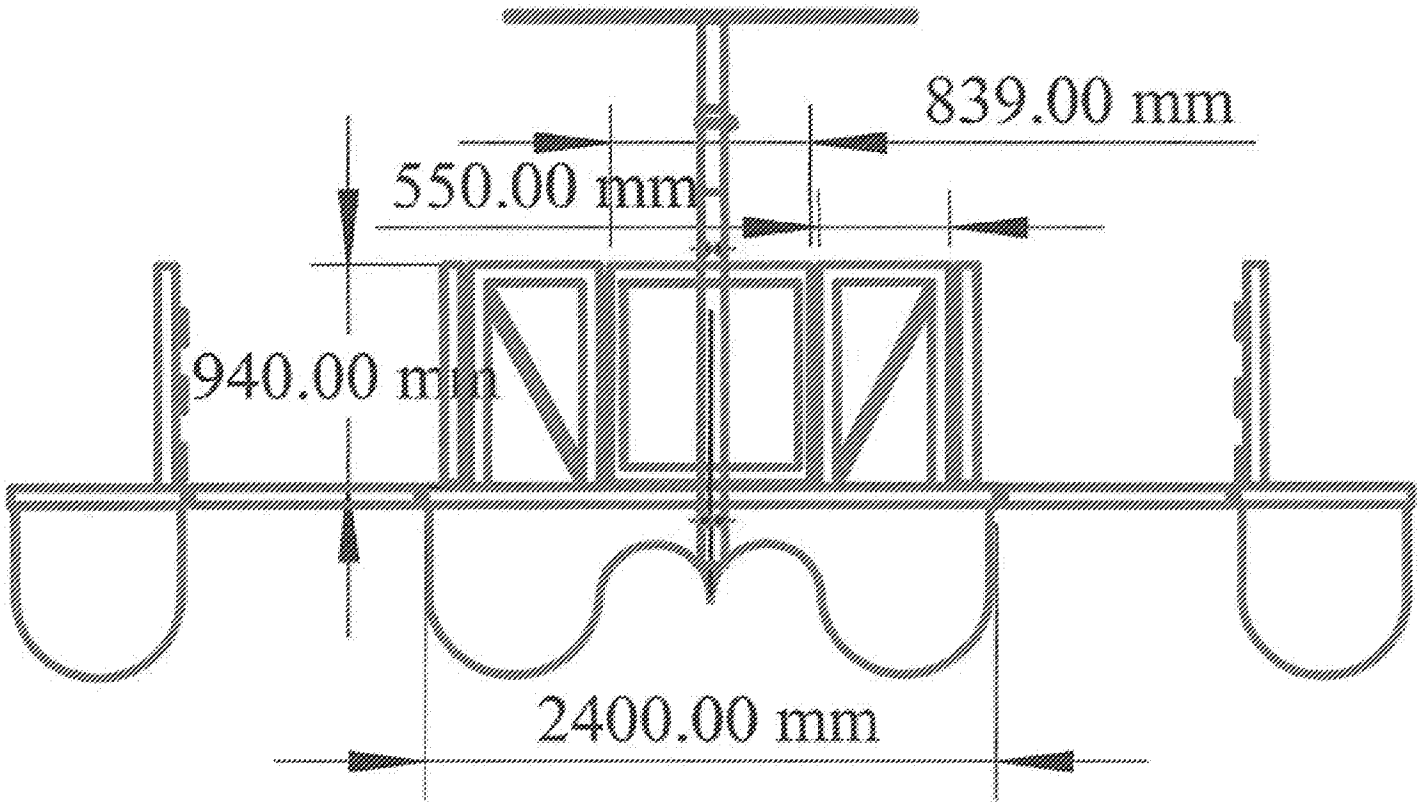
FIG. 4 shows the front elevation view of the boat structure, including exemplary dimensions, with the hinged gates open in accordance with an embodiment

Specifically, FIGS. 3 and 4 show the boat structure 1 in the deployed configuration for use. As can be seen, structure 1 supports a number of floats which, in the deployed configuration, are substantially laterally adjacent in catamaran configuration.

Figure 2:
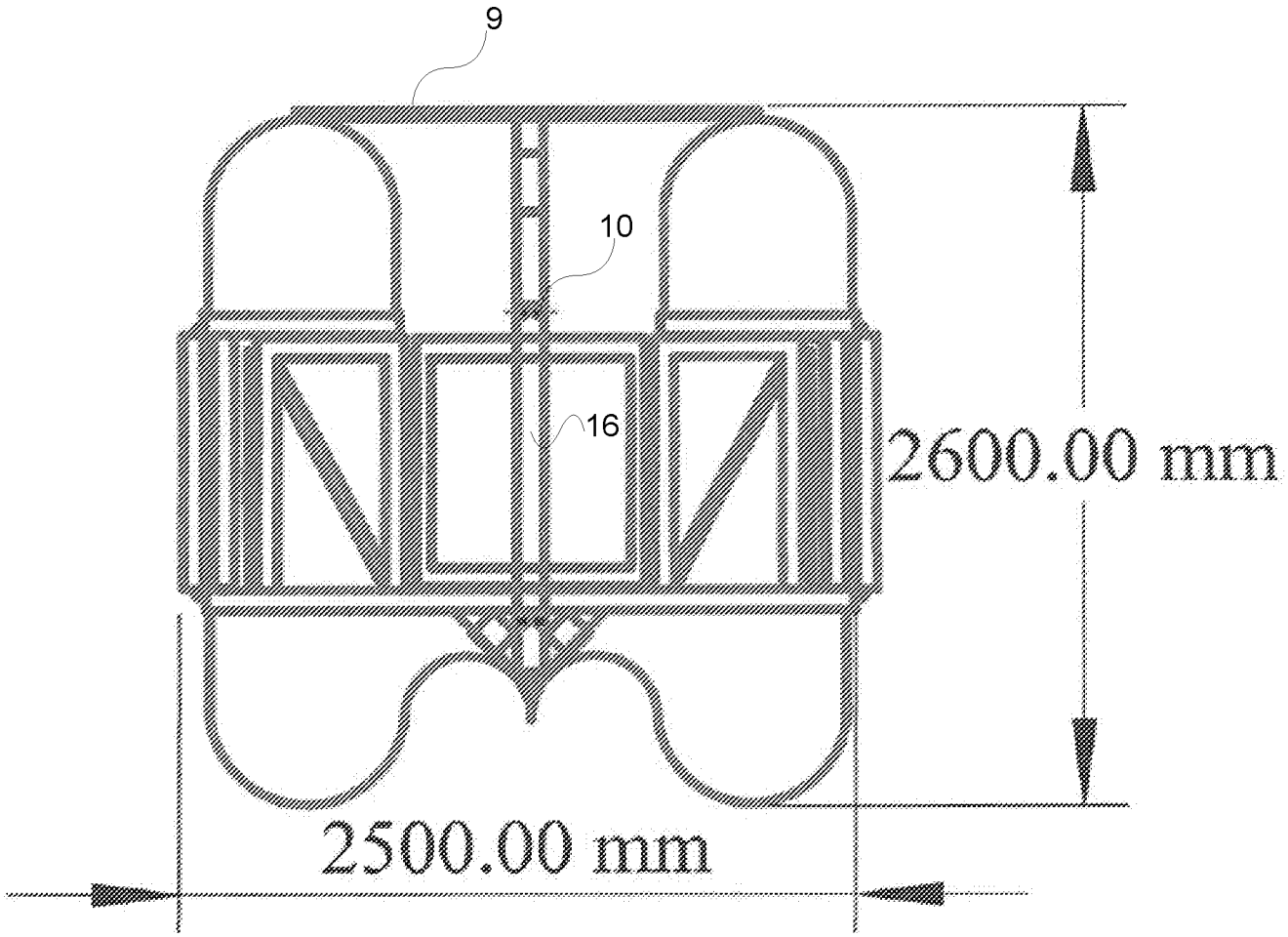
FIG. 2 shows a front view of the folding boat structure in the stowed configuration in accordance with the preferred embodiment of the present disclosure.

FIG. 1 shows the boat structure 1 in a part folded configuration and FIG. 2 shows the structure 1 in the stowed configuration.

Now, specifically, the folding boat structure 1 comprises a central structure 2 having a fixed primary hull 8. In the embodiment shown, the primary hull 8 takes the form of a bifurcated Shark Cat design. However, as can be appreciated, differing hull designs may be utilised within the purposive scope of the embodiments described herein.

The structure 1 further comprises outriggers 3 supporting at least one secondary hull structure. Each secondary hull structure comprises a secondary hull 6. In the embodiment shown, the structure 1 comprises a pair of secondary hulls 6 located respectively opposite and adjacent the main hull 8 in the deployed configuration.

In a preferred embodiment, the structure 1 may be manufactured from a combination of aluminium and fibreglass so as to provide for a lightweight structure aiding transportation.

Now, the outriggers 3 are double hinged so as to be user configurable in the deployed configuration as substantially shown in FIGS. 3 and 4 and in the stowed configuration as substantially shown in FIG. 2.

Specifically, in the deployed configuration, the at least one secondary hull 6 is located laterally adjacent the main hull 8 in catamaran configuration and is downwardly orientated.

Furthermore, in the stowed configuration, the at least one secondary hull 6 is located above the main hull 8 and upwardly orientated. As can be appreciated, and as alluded to above, being able to transition from the deployed configuration to the stowed configuration as shown provides a boat structure 1 offering very large deck area yet while being able to have a narrow width (such as less than 2.5 m, for example) so as to be able to be legally transported by road by trailer or the like.

Furthermore, the transitioning from the stowed to the deployed configuration is a relatively simple and quick process requiring no construction, fastening and the like as is the case with existing arrangements.

Now, considering the outrigger 3 in further detail, as can be seen, the outrigger 3 comprises a beam 7 hingedly coupled by way of hinges 14 at each end of the beam 7 to the central structure 2 and the secondary hull structure respectively.

As can be appreciated, the double hinges 14 allow the secondary hulls 6 to transition from the downward orientation as substantially shown in FIGS. 3 and 4 to the upper orientation as substantially shown in FIG. 2.

In embodiments, the structure 1 further comprises a railing 5 which is fixed to the secondary hull structure. In the deployed configuration as substantially shown in FIGS. 3 and 4, the railing 5 is substantially vertically orientated so as to form a peripheral outer deck area railing.

As can be seen from the stowed configuration 2 as substantially shown in FIG. 2, the railing 5 is again substantially vertically orientated.

As can be seen from FIG. 1 where the structure 1 is transitioning between the deployed configuration and the stowed configuration, the railing 5 is configured and located so as to bear against the beam 7.

In other words, while folding the secondary hull 6 upwards, the railing 5 comes down to bear against the beam 7 so as to limit the further travel of the secondary hull 6 about the hinge on 14 beyond the right angle shown. In other words, the railing 5, while serving a useful purpose of providing a railing or the like, additionally provides the support to hold the secondary hull 6 at substantial right angles to the beam 7 so as to allow the structure 1 to take on the stowed configuration as substantially shown in FIG. 2.

Now, as can be appreciated, in the deployed configuration, the buoyancy of the secondary hulls 6 may deflect the beam 7 upward. As such, in a preferred embodiment, the boat structure 1 comprises a beam holding mechanism to hold the beam 7 substantially horizontal as substantially shown in FIGS. 3 and 4.

Specifically, in a preferred embodiment shown, the beam holding mechanism comprises hinged gates 4 configured to swing outwards and to fasten to the railing 5 so as to hold the beam 7 in place. As can be seen from at least FIG. 3, the hinge gate 4 may comprise diagonal reinforcement or the like so as to allow the hinged gate 6 to withstand the forces acting on the beam 7 from the secondary hull 6. As can also be seen from FIG. 3, the hinged gate 4 may connect to the upper deck room compartmentalising framework 17.

In a preferred embodiment, the boat structure 1 may comprise an actuator to raise and lower the outrigger 3. Specifically, in a preferred embodiment, the boat structure 1 further comprises an electric winch (not shown) to raise and lower the outrigger 3.

Specifically, in embodiments, and making reference to FIG. 2, the winch may be located beneath deck with winch cables rising via mast 16 and extending horizontally from winch rollers 10 for fastening to the outer peripheral edges of the secondary hulls 6. The winch cables may extend across the tops of the railing 5.

Preferably, the winch cables are releasably fastened to the secondary hulls 6 so as to allow the cables to be stowed once the secondary hulls 6 have been raised or lowered. In a further preferred embodiment, the secondary hulls 6 comprise winch cable fasteners which may be reassessed or the like so as to remove unnecessary protrusions and the like.

As such, so as to transition the structure 1 from the deployed configuration to the stowed configuration, the user would unwind the winch to allow the winch cables to be drawn from the winch rollers 10 of the mast 16. One sufficiently extended, the user would clip the ends of the winch cables to the winch cable fasteners of the secondary hulls 6. Thereafter, the user would activate the winch so as to allow the winch to firstly pull the secondary hull structures and secondary hulls 6 through 90 °as substantially shown in FIG. 2 and then into the stowed configuration as substantially shown in FIG. 1.

Considering now FIGS. 2 and 3, in a preferred embodiment, the folding boat structure further comprises a telescopic bimini 9. Specifically, the bimini 9 framework may be provided with shade cloth, canvas or the like so as to protect the innermost deck from the elements.

Specifically, in the deployed configuration shown in FIG. 3, the telescopic bimini 9 is extended upwardly so as to raise the ceiling height of the structure 1. However, once in the stowed configuration as substantially shown in FIG. 2, the bimini 9 is be retracted and, in embodiments, retracted so as to rest against the upper surfaces of the secondary hulls 6.

Now, as can be seen from at least FIG. 1, the structure 1 comprises a room defining compartmentalising framework 17 being configured so as to divide the upper deck into various rooms, such as entertainment areas, bedrooms, bathrooms and the like. As can be seen, the framework 17 raises only to a certain height so as to allow the secondary hulls 6 to rest upon the framework 17 such that the structure 1 does not exceed the 2.6 m height as substantially shown in FIG. 2.

Now, operably coupled to the framework 17 may be canvas walling or the like fastened to the bimini 9. As such, as the bimini 9 raises, the canvas walling similarly raises so as to provide the differing rooms of the deck with sufficient head height.

Figures 5A, 5B, 5C:
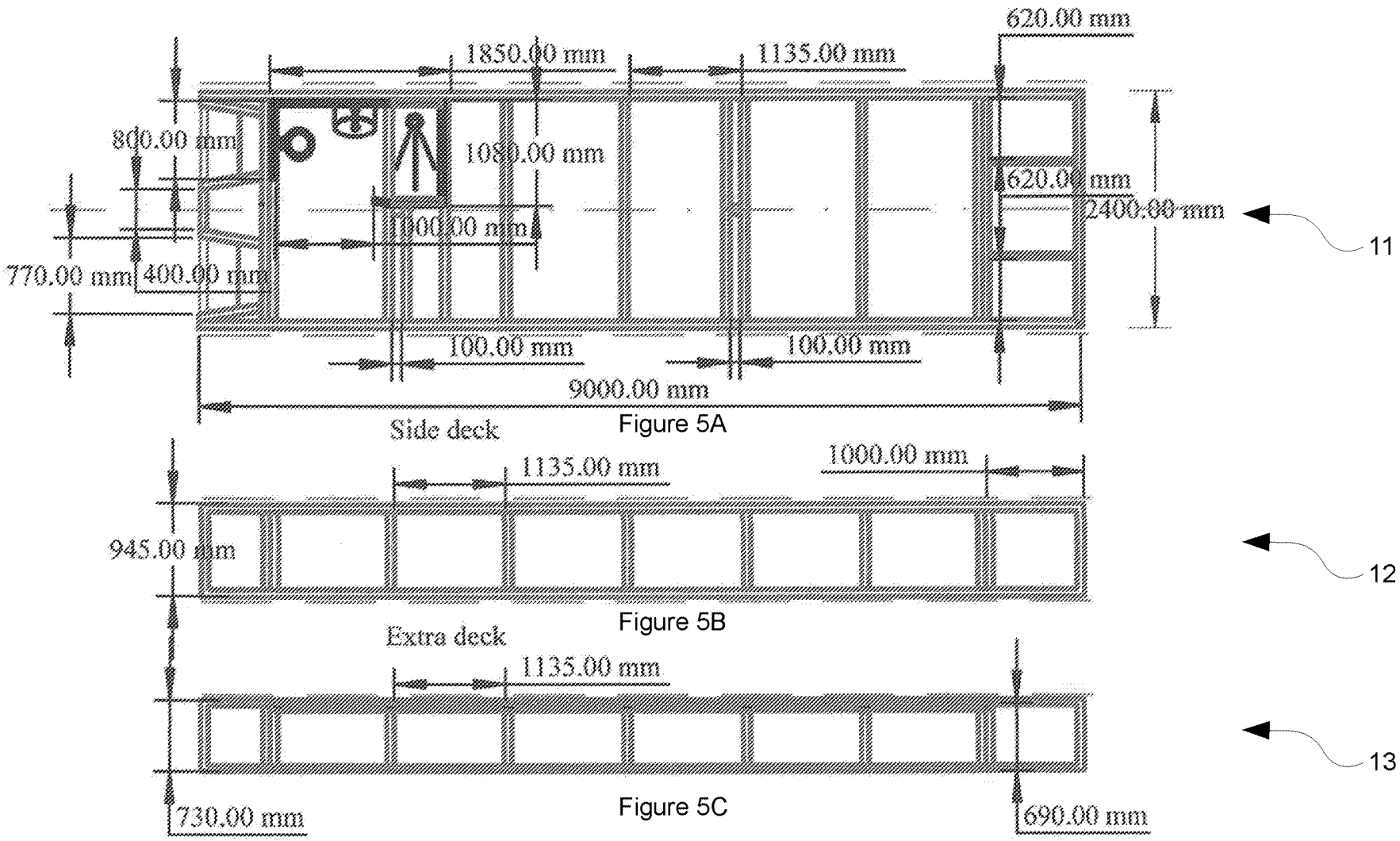
FIG. 5 shows a top plan view of the folding boat structure, including exemplar dimensions, in accordance with an embodiment of the present disclosure.

Specifically, turning now to FIG. 5 there is shown a top plan view of the structure 1. In the embodiment shown, the stern is shown on the left and the bow on the right. FIG. 5A shows the main deck atop the central structure, FIG. 5B shows the outer inner-railing deck area above the beam 7 and FIG. 5C shows the outer outer-railing deck area atop the secondary hulls 6.

As can be seen from FIG. 5A, the rear of the structure 1 has allowance for twin outboard motors. Next adjacent are rooms for toilets, showers and the like. Further on, towards the bow are provided bedrooms, entertainment areas and the like.

For entertainment areas, flatscreen television devices and other electronic equipment may be provided on lifting actuators, so as to raise up with the extension of the bimini 9. At the bow, the structure 1 may comprise a front access gate allowing passengers to board via a ramp or the like.

Adjacent the front access gate may be hatches for allowing access to within the main hull 8.

Turning now to FIGS. 6-9, there is illustrated the transitioning of the boat structure 1 from the stowed configuration to the deployed configuration.

Figure 6:
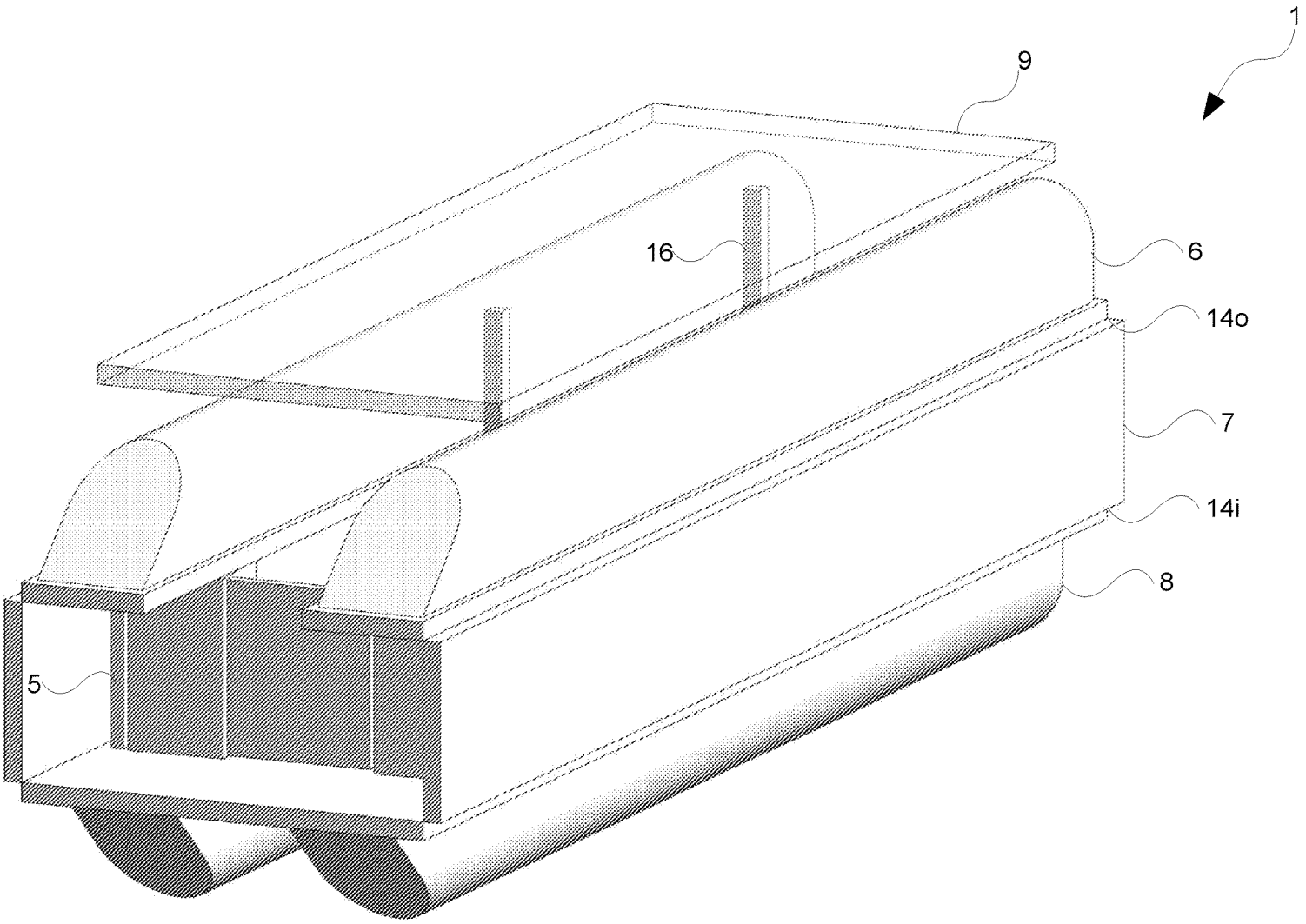

Specifically, considering initially FIG. 6, there is shown the boat structure 1 in the stowed configuration. In this stowed configurations, the boat structure 1 may be on a trailer so as to be suited for road transportation.

Now, for the deployment of the boat structure 1, the trailer may be reversed to the waters edge so as to allow for the deployment of the boat structure 1. In one embodiment, the boat structure 1 may be deployed whilst on the trailer for subsequent launching. In further embodiments, the boat structure 1 may be deployed whilst on the water and wherein, in such an embodiment, the boat structure 1 may comprise mechanised actuators to deploy the outrigging so as to overcome the buoyancy of the secondary hulls 6.

As is shown in FIG. 6, in the stowed configurations, the secondary hulls 6 are upwardly orientated and located directly above the primary hulls 8 beneath which downwardly orientated. Furthermore, both outer hinge 14*o* and any hinge 14*i* are at 90° so as to allow the hulls 6, 8 detect such a configuration with the beam 7 transitioning vertically therebetween.

As alluded to above, such a configuration provides a compact structure of minimal width being suited for road transportation. In the embodiments shown, the boat structure 1 comprises a pair of catamaran primary hulls 8 as opposed to the single Shark Cat hull design disclosed above.

Prior to deployment, the bimini 9 may be raised on telescopic masts 16 away from the secondary hulls 6.

Figure 7:
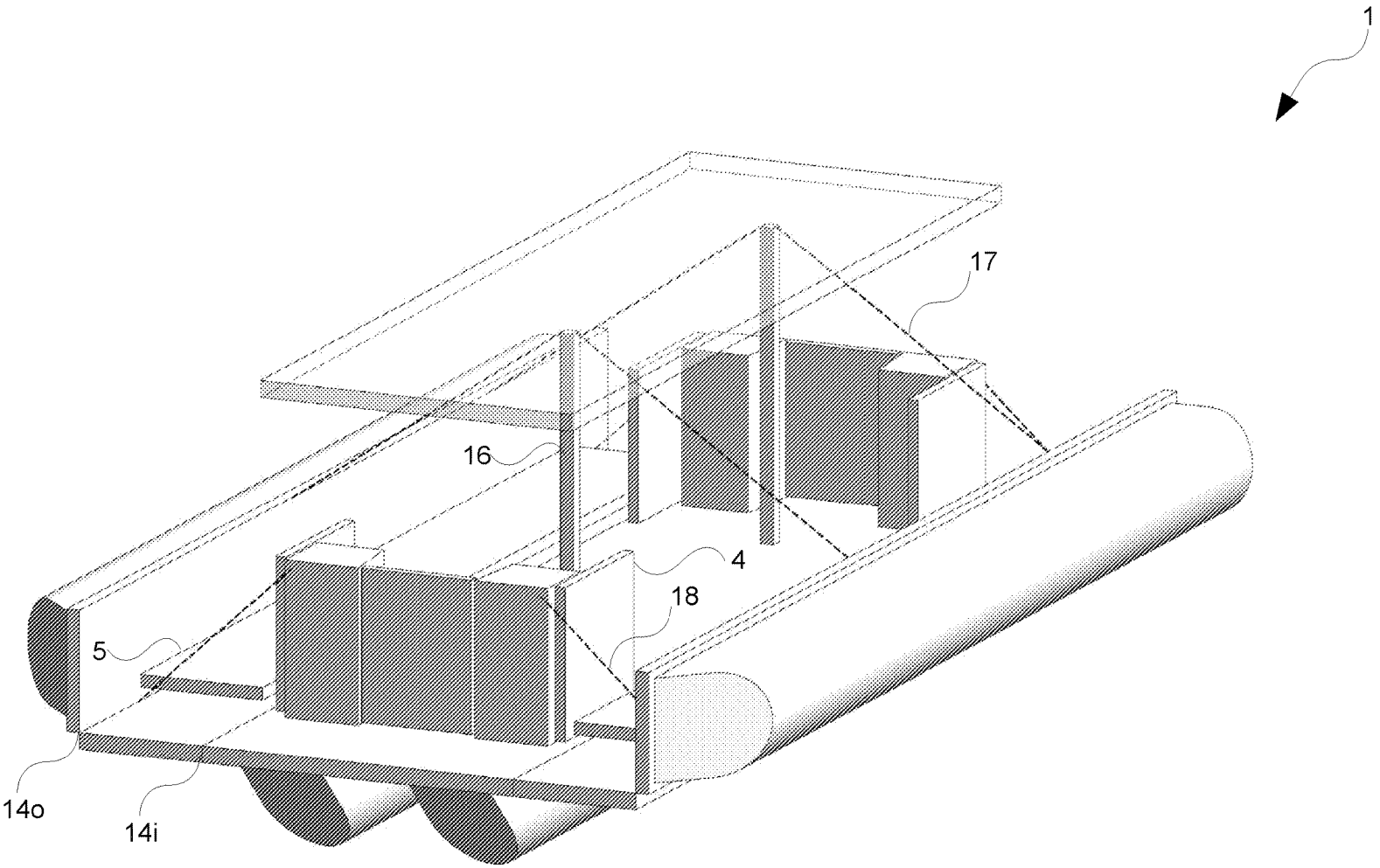

Turning to FIG. 7, there is shown the first stage of the transition to the deployed configuration wherein, as can be seen, the outrigging is being folded outwardly supported by winch cabling 17. Specifically, as can be seen, winch cabling 17 may stem from the mast 16 which may be fastened to the outer edges of the outrigging. Furthermore, in embodiments, further winch cabling 18 may be provided and connected to the outrigging substantially at the outer hinge 14*o*.

In embodiments, the winch cabling 17, 18 may be controlled independently utilising independent electric motors (which may be controlled by a controller appropriately synchronising the independent electric motors) such that the structure 1 transitions in the manner shown in the illustrations such that the inner hinge 14*i* pivots first followed by the outer hinge 14*o*.

Specifically, is shown in FIG. 7, the winch cabling 17, 18 is controlled such the inner hinge 14*i* is now at 180°. Furthermore, as is shown, the railing 5, fastened to the outer outrigging portion, rest against the inner outrigging portion so as to limit the angle therebetween to substantially 90°.

Figure 8:
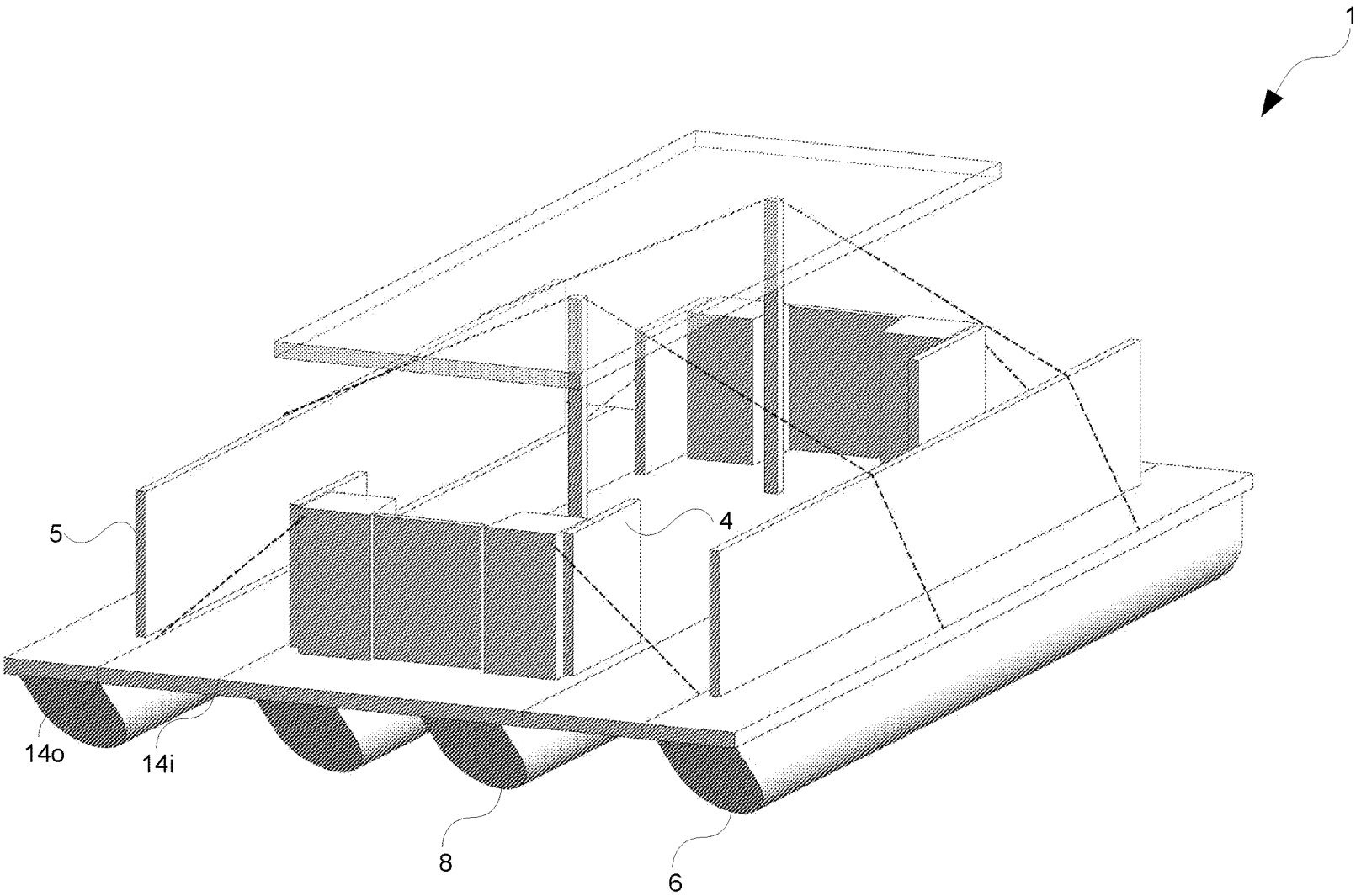

Turning now to FIG. 8, there is shown the further stage of the transition wherein, as can be seen, the outer hinge 14*o* is now also substantially at 180°.

As can also be seen from FIG. 8, the formerly horizontal railing 5 is now vertical so as to bound the deck.

Once in such configurations, the winch cabling 17, 18 may be disconnected and stowed.

Figure 9:
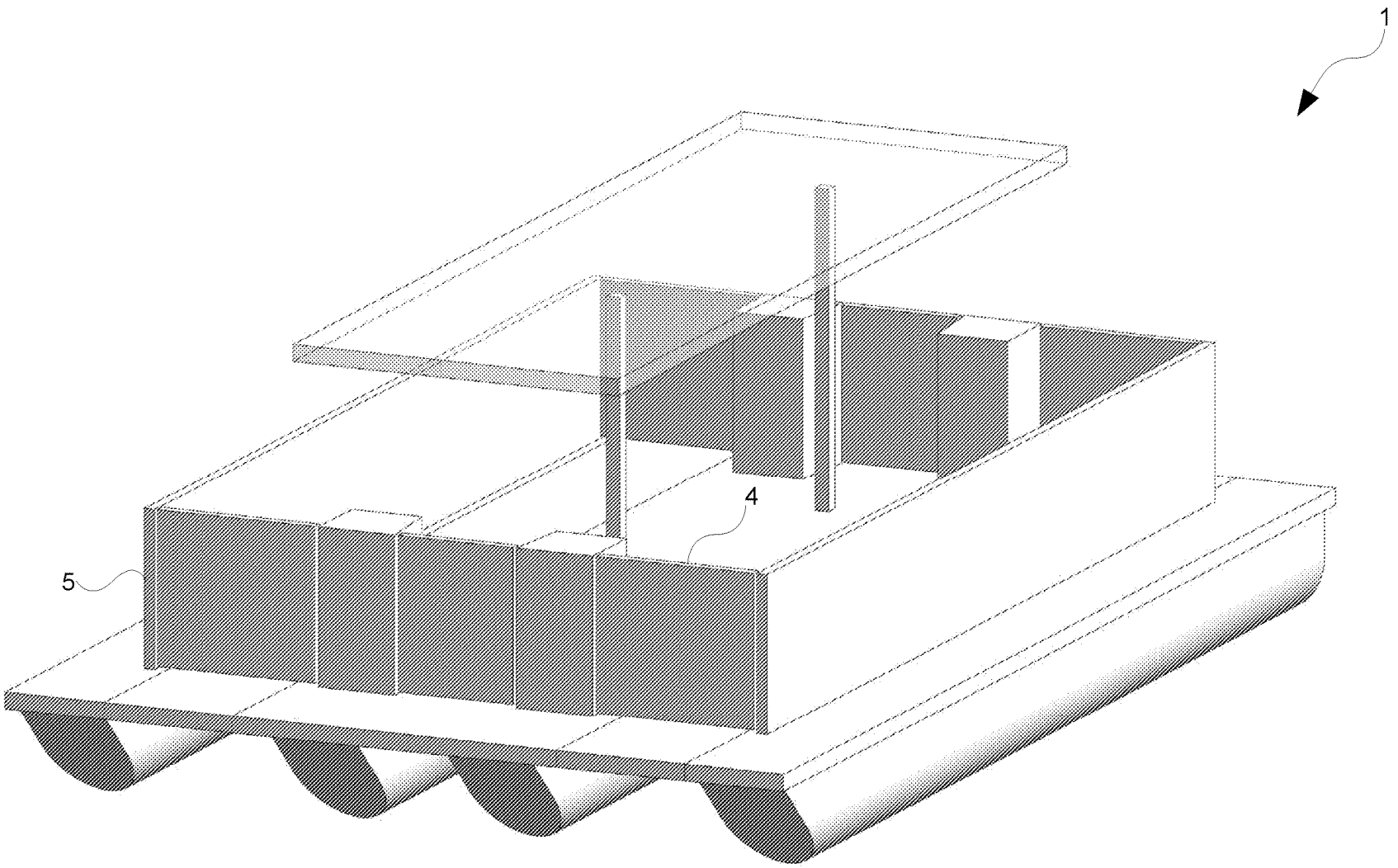

Turning now to FIG. 9, the swing gates 4 may be closed so as to rigidly hold the outrigging laterally and to prevent the upward forces from the buoyancy of the outer hulls 6 to push the outrigging upwards.

For the storage of the structure 1, the aforedescribed process may be performed in reverse.

Interpretation

Embodiments:

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

Industrial Applicability

It is apparent from the above, that the arrangements described are applicable to the boat construction industries.

The invention claimed is:

1. A folding boat structure for facilitating transportation, the structure comprising:

a central structure having a fixed primary hull;

outrigging supporting at least one secondary hull structure having a secondary hull to the central structure, wherein:

the outrigging is double hinged so as to be user configurable in a deployed configuration and a stowed configuration and wherein:

in the deployed configuration, the at least one secondary hull is located laterally adjacent the primary hull and downwardly orientated; and in the stowed configuration, the at least one secondary hull is located above the primary hull and upwardly orientated; and wherein the boat structure further comprises at least one railing fixed to the secondary hull structure, and wherein, in the stowed configuration, the railing is configured for bearing against a beam so as to limit the travel of the secondary hull structure with respect to the beam at an approximate right angle.

2. The folding boat structure as claimed in claim 1, wherein the outrigging comprises a beam hingedly coupled at each end of the beam to the central structure and the secondary hull structure respectively.

3. The folding boat structure as claimed in claim 2, wherein the structure further comprises a beam holding mechanism to hold the beam in the deployed configuration.

4. The folding boat structure as claimed in claim 3, wherein the beam holding mechanism comprises a hinged gate configured to swing outwards in the deployed configuration.

5. The folding boat structure as claimed in claim 4, wherein, in the deployed configuration, the hinged gate latches to the railing.

6. The folding boat structure as claimed in claim 1, further comprising a winch system to transition the structure between the deployed and stowed configurations.

7. The folding boat structure as claimed in claim 6, wherein the winch system comprises a mast and winch cables and wherein the winch cables travel upwards through the mast and subsequently exit the mast to as to reach laterally for fastening to the secondary float structure.

8. The folding boat structure as claimed in claim 7, wherein the secondary float structure comprises recessed winch cable fastener engagements.

9. The folding boat structure as claimed in claim 1, further comprising a bimini top.

10. The folding boat structure as claimed in claim 9, wherein the bimini top is height adjustable, and wherein, in the deployed configuration, the bimini top is raised and wherein, in the stowed configuration, the bimini top is lowered.

11. The folding boat structure as claimed in claim 10, wherein, in the stowed configuration, the bimini top rests against the secondary hulls.

12. The folding boat structure as claimed in claim 11, wherein the bimini top comprises a telescopic member.

13. The folding boat structure as claimed in claim 1, further comprising a compartmentalising framework compartmentalising a deck into a plurality of rooms and wherein, in the stowed configuration, the secondary hull structure is configured for resting upon the compartmentalising framework.

14. The folding boat structure as claimed in claim 13, wherein the structure further comprises elevating walling fastened between the compartmentalising framework and a bimini top such that, when the bimini top is raised in the deployed configuration, the elevating walling extends upwardly from the compartmentalising framework.

15. The folding boat structure as claimed in claim 1, wherein, in the stowed configuration, the structure has a width of approximately 2.5 m or less.

16. The folding boat structure as claimed in claim 1, wherein, in the deployed configuration, the structure has a width of approximately 5.8 m or more.

17. The folding boat structure as claimed in claim 1, wherein the structure has a length of approximately 9 m.

18. A folding boat structure for facilitating transportation, the structure comprising:

a central structure having a fixed primary hull;

outrigging supporting at least one secondary hull structure having a secondary hull to the central structure, wherein:

the outrigging is double hinged so as to be user configurable in a deployed configuration and a stowed configuration; and a winch system to transition the structure between the deployed and stowed configurations, wherein:

in the deployed configuration, the at least one secondary hull is located laterally adjacent the primary hull and downwardly orientated; and in the stowed configuration, the at least one secondary hull is located above the primary hull and upwardly orientated.

19. A folding boat structure for facilitating transportation, the structure comprising:

a central structure having a fixed primary hull;

outrigging supporting at least one secondary hull structure having a secondary hull to the central structure, wherein:

the outrigging is double hinged so as to be user configurable in a deployed configuration and a stowed configuration; and a compartmentalising framework compartmentalising a deck into a plurality of rooms and wherein, in the stowed configuration, the secondary hull structure is configured for resting upon the compartmentalising framework, and wherein:

in the deployed configuration, the at least one secondary hull is located laterally adjacent the primary hull and downwardly orientated; and in the stowed configuration, the at least one secondary hull is located above the primary hull and upwardly orientated.

* * * * *